US007396277B2

(12) United States Patent
Kao

(10) Patent No.: US 7,396,277 B2
(45) **Date of Patent: *Jul. 8, 2008**

(54) COIN COUNTER HAVING IMPROVED ADJUSTING MECHANISMS

(75) Inventor: Li-Hui Kao, Yonghe (TW)

(73) Assignee: Origo Klebe Technik Co., Ltd, Taipei (TW)

( * ) Notice: Subject to any disclaimer, the term of this patent is extended or adjusted under 35 U.S.C. 154(b) by 524 days.

This patent is subject to a terminal disclaimer.

(21) Appl. No.: 11/008,942

(22) Filed: Dec. 13, 2004

(65) Prior Publication Data

US 2006/0148396 A1 Jul. 6, 2006

(51) Int. Cl.
*G07D 1/00* (2006.01)
*G07D 9/04* (2006.01)

(52) U.S. Cl. ..... 453/57; 453/30

(58) Field of Classification Search ..... 453/57, 453/18, 29, 30, 31, 32, 56; 198/586, 626.3–6, 198/861.1

See application file for complete search history.

(56) References Cited

U.S. PATENT DOCUMENTS 3,757,805 A * 9/1973 Puhahn et al. ..... 453/57
4,441,516 A * 4/1984 Stadler et al. ..... 453/30

* cited by examiner

*Primary Examiner*—Patrick Mackey
*Assistant Examiner*—Mark Beauchaine
(74) *Attorney, Agent, or Firm*—Apex Juris, pllc; Tracy M Heims

(57) ABSTRACT

A coin counter includes a chassis supporting a rotary disk and a chute extending from the disk. An operation device is arranged below one side of the chute and includes first and second plates coupled to an adjusting valve. First and second posts extend from ends of the first and second plates, respectively and are fixed to the chassis. A thickness adjusting mechanism is fixed to and supported by the second post, while a coin forwarding mechanism is fixed to and supported by the first post. Such a construction allows the thickness adjusting mechanism and the coin forwarding mechanism to be individually removable from the chassis as individual sub-assemblies, which facilitates ready mounting/dismounting and thus easy maintenance and repairing.

10 Claims, 9 Drawing Sheets

COIN COUNTER HAVING IMPROVED ADJUSTING MECHANISMS

FIELD OF THE INVENTION

The present invention generally relates to a coin counter, and in particular to a coin counter having adjusting mechanisms that can be separately removed from the coin counter for easy maintenance and repairing.

BACKGROUND OF THE INVENTION

A conventional coin counter comprises a support board or a chassis on which a rotary disk is mounted. A conveyor is arranged above the rotary disk and an actuation element is provided for driving the conveyor. A control circuit is provided for controlling the operation of the counter. Two adjusting mechanisms are provided close to the rotary disk for adjusting width and thickness of a coin passage. A coin dispenser is arranged at an end of the coin passage. A coin forwarding mechanism and a sensor electrically coupled to the control circuit are arranged alongside the coin passage for forwarding the coins to be counter and counting the number of the coins passing through the passage, respectively. An actuation device is arranged below the support board and comprises a spindle coupled to gears that mate one another. One of the gears is coupled to the rotary disk. The actuation device and the conveyor are electrically connected to the control circuit whereby the control circuit controls the operation of the actuation device and the conveyor. An enclosure houses the support board and the components and/or sub-assemblies on the support board. The enclosure defines a receiving hopper corresponding to the conveyor for receiving coins to be counted, which coins are then conveyed by the conveyor to the disk. By means of the rotation of the disk, the coins are forced into the coin passage and then moved by the coin forwarding mechanism toward the coin dispenser at which the coins are discharged.

The conventional coin counter, although working well for counting coins, comprises a number of parts or sub-assemblies that are mounted to the support board, which complicates the construction of the coin counter. Due to the frequent use of the coin counter, especially in the financial business, maintenance and repairing are definitely needed. Two of the most frequently damaged sub-assemblies are the thickness adjusting mechanism and the coin forwarding mechanism for they are constantly subject to impact of the coins moving along the coin passage. One commonly observed problem is coin jamming inside the coin passage. Such a complicated construction comprised of a great number of parts makes it not possible for a general user to do repairing or maintenance by himself or herself. Thus, a maintenance technician must be called or the machine be sent back to the factory for repairing and maintenance. This inevitably increases the costs of using the coin counter. In addition, such a great number of parts often result in lose of one or two small parts and this makes the maintenance and repairing operation difficult and inconvenient.

Thus, the present invention is aimed to provide a coin counter having improved adjusting mechanisms for overcoming the drawbacks of the conventional coin counter.

SUMMARY OF THE INVENTION

Thus, a primary objective of the present invention is to provide a coin counter comprising a thickness adjusting mechanism and a coin forwarding mechanism that are individual sub-assemblies and can be removed separately.

Another objective of the present invention is to provide a coin counter having a construction that allows for ready mounting/dismounting and thus easy maintenance and repairing.

To achieve the above objective, in accordance with the present invention, a coin counter is provided, comprising a chassis supporting a rotary disk and a chute extending from the rotary disk. A conveyance mechanism is arranged above the rotary disk. A power mechanism is positioned below the chassis and a transmission is coupled to the power mechanism. A control circuit is provided on the chassis. A width adjuster arranged alone one side of the chute and a thickness adjusting mechanism and a coin forwarding mechanism are arranged in the proximity of the chute. The coin counter further comprises an operation device that is arranged below one side of he chute and comprising a first plate and a second plate. The first plate has one end from which a first post extends and an opposite end at which the second plate is arranged. The second plate having an end from which a second post extends, the posts being fixed to the chassis. A baffle plate is arranged between the posts. An adjusting valve is coupled to both the first and second plates. The thickness adjusting mechanism comprises a base defining a fixing hole fit over the second post and an adjuster pivoted to one side of the base, an opposite side of the base forming a locking element with which a hook element formed on the adjuster is engageable. The coin forwarding mechanism comprises a cover and a base pivoted to one side of the cover and defining a fixing hole fit over the first post, a coin moving device being pivotally attached to one side of the base, the base also forming a locking element with which a hook element formed in the cover is engageable. Thus, the coin adjusting mechanism and the coin forwarding mechanism are individual sub-assemblies, which facilitates ready mounting/dismounting for repairing and maintenance.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 8:
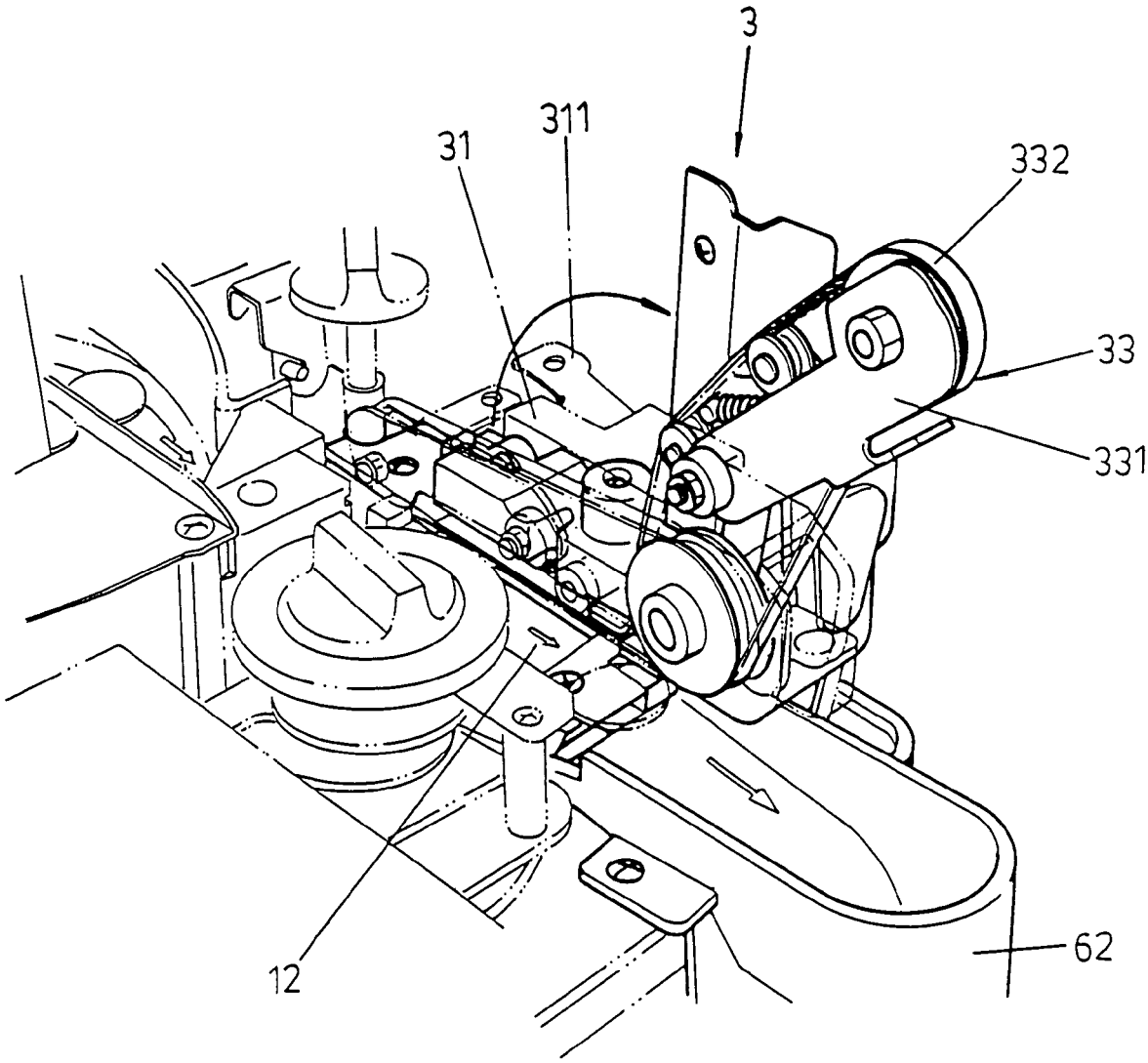
FIG. 8 is a perspective view of a portion of the coin counter of the present invention with the enclosure removed to particularly illustrate the operation of the coin forwarding mechanism.
Figure 9:
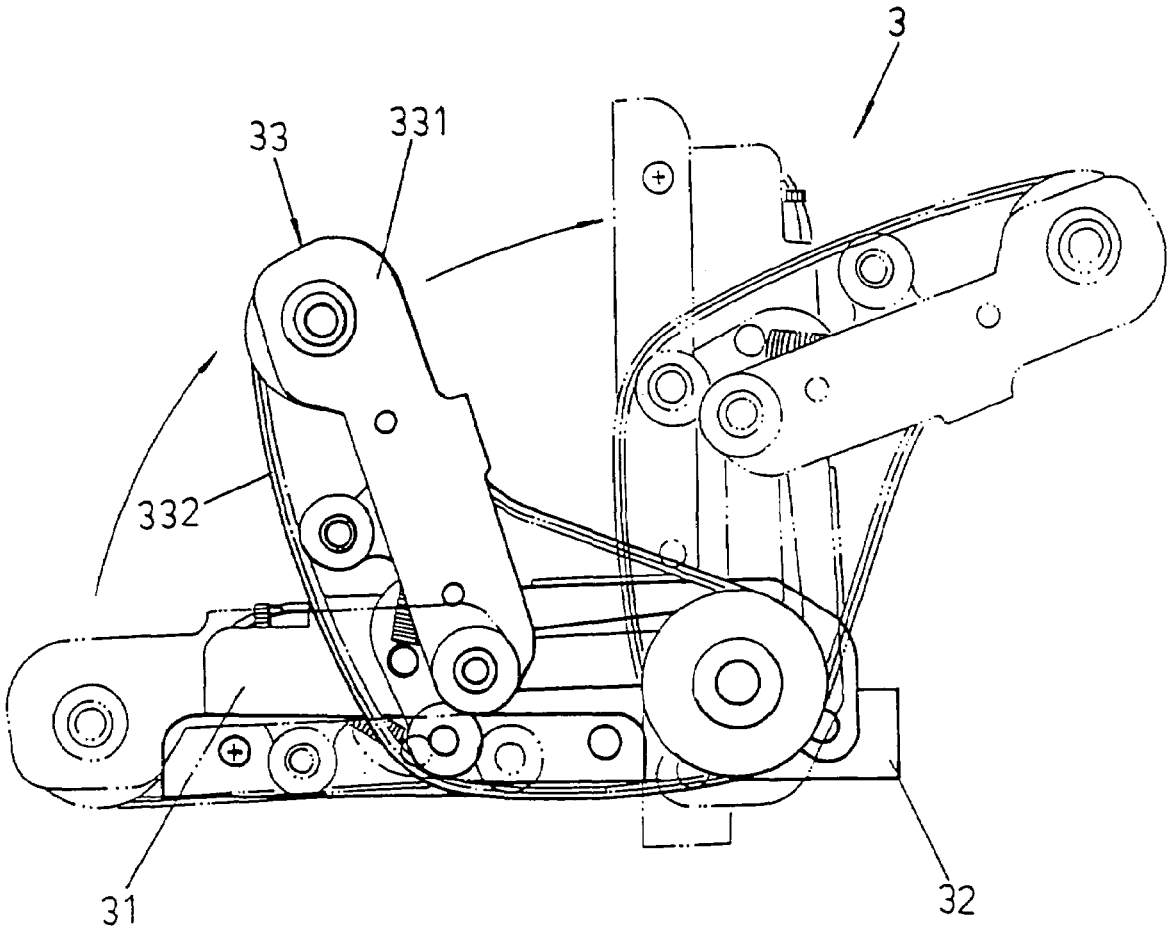
FIG. 9 is a side elevational view also showing the operation of the coin forwarding mechanism.

With reference to the drawings and in particular to FIGS. 1-5, a coin counter constructed in accordance with the present invention comprises a chassis 1 on which a rotary disk 11 is rotatably mounted. A chute 12 (see FIG. 8) extends from the rotary disk 11 to a coin dispensing structure 62. A width adjuster 13 is arranged on one side of the chute 12. Also arranged alongside the chute 12 are a thickness adjusting mechanism 2 and a coin forwarding mechanism 3. A conveyance mechanism 4 is arranged above the rotary disk 11. A power mechanism 5 is arranged under the chassis 1 and is coupled to a transmission (not shown). A control circuit 14 is provided on the chassis 1 in proximity of the rotary disk 11. An enclosure 6 that forms the coin dispensing structure 62 is provided to house the chassis 1, as well as the other components. The enclosure 6 forms a receiving hopper 61 corresponding in position to the conveyance mechanism 4 for receiving coins (not shown) to be counted. The enclosure 6 also forms a coin return opening 63 below the chute 12.

Figure 1:
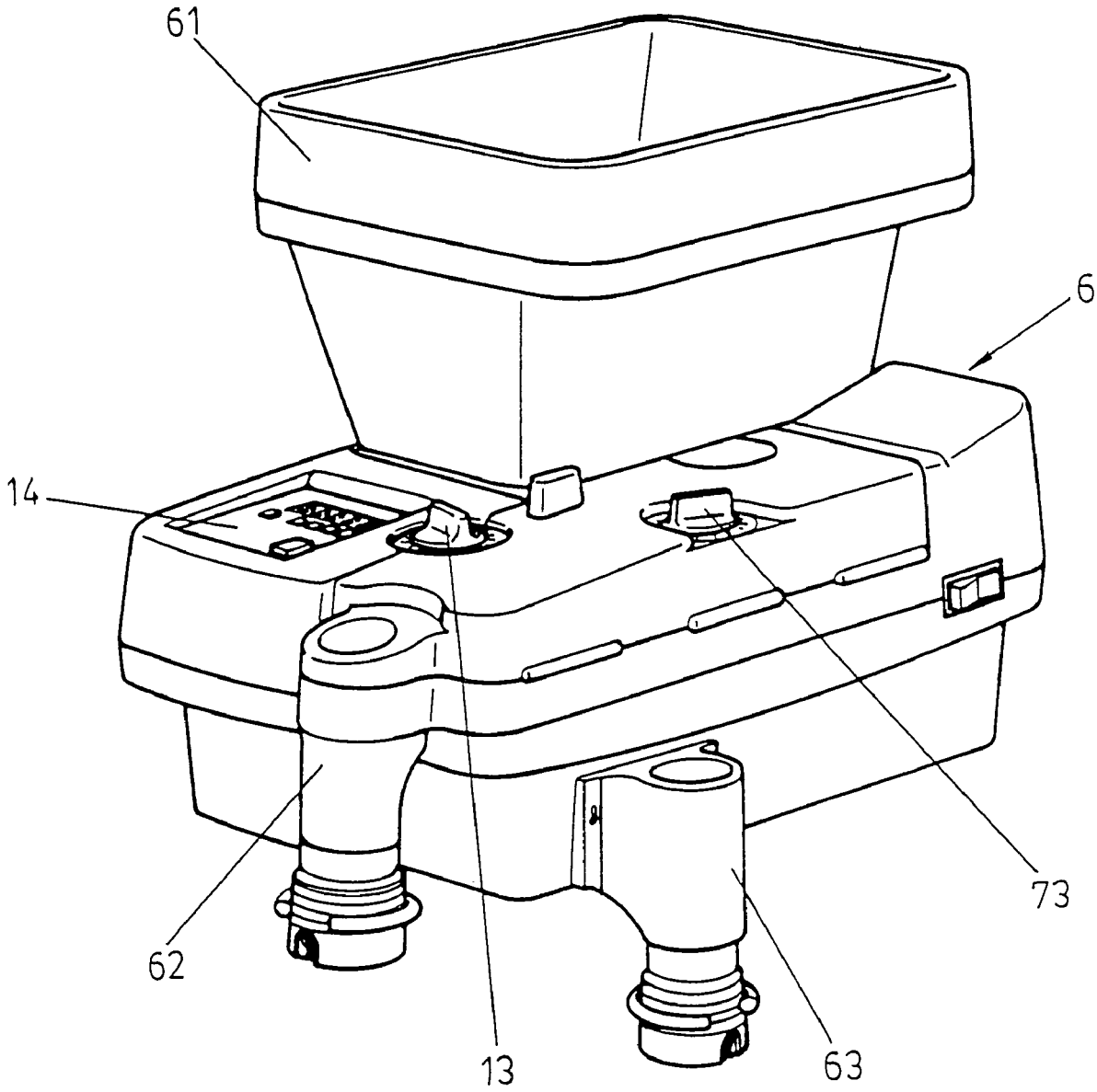
FIG. 1 is a perspective view of a coin counter constructed in accordance with the present invention.
Figure 2:
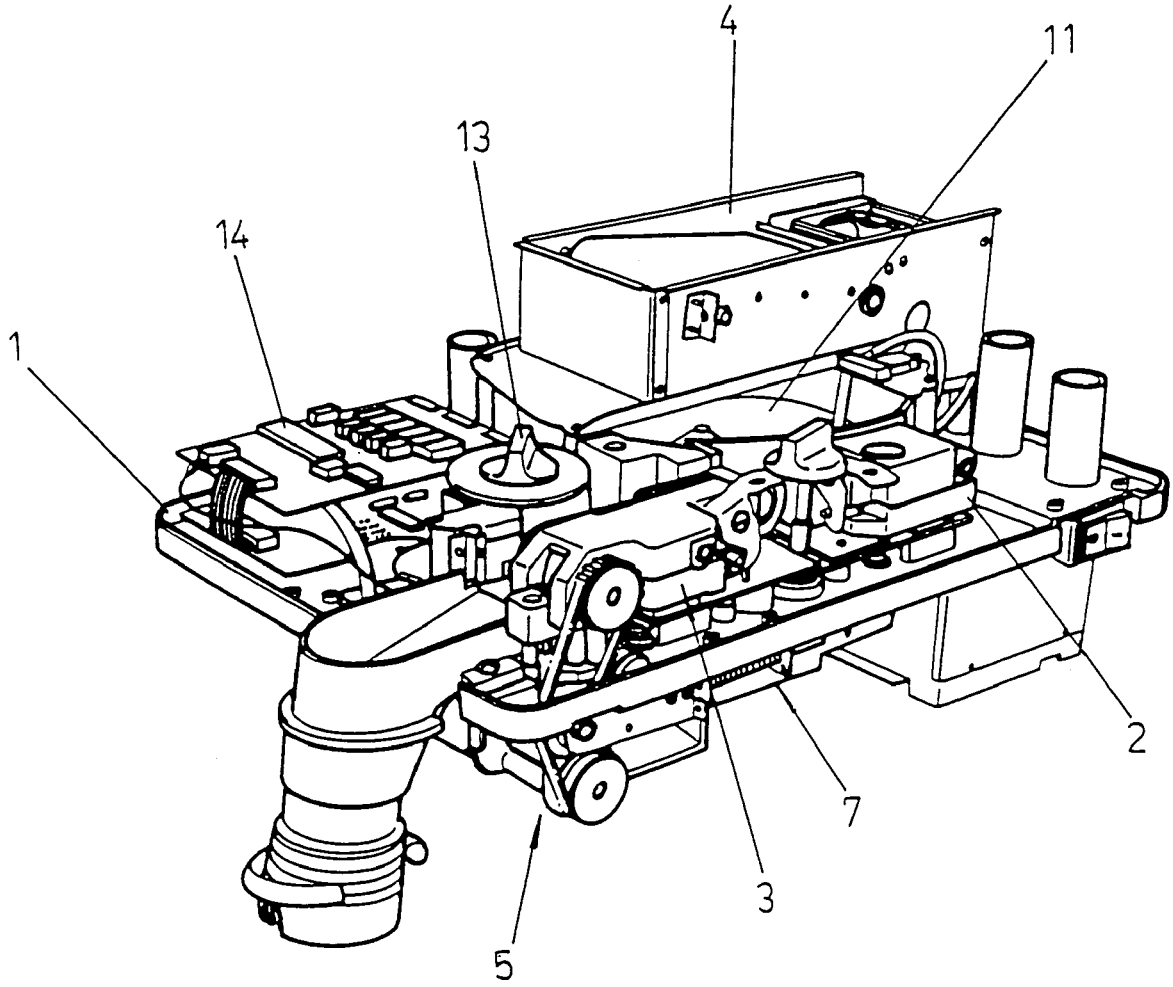
FIG. 2 is a perspective view of the coin counter of the present invention with an enclosure removed to show inside details.
Figure 3:
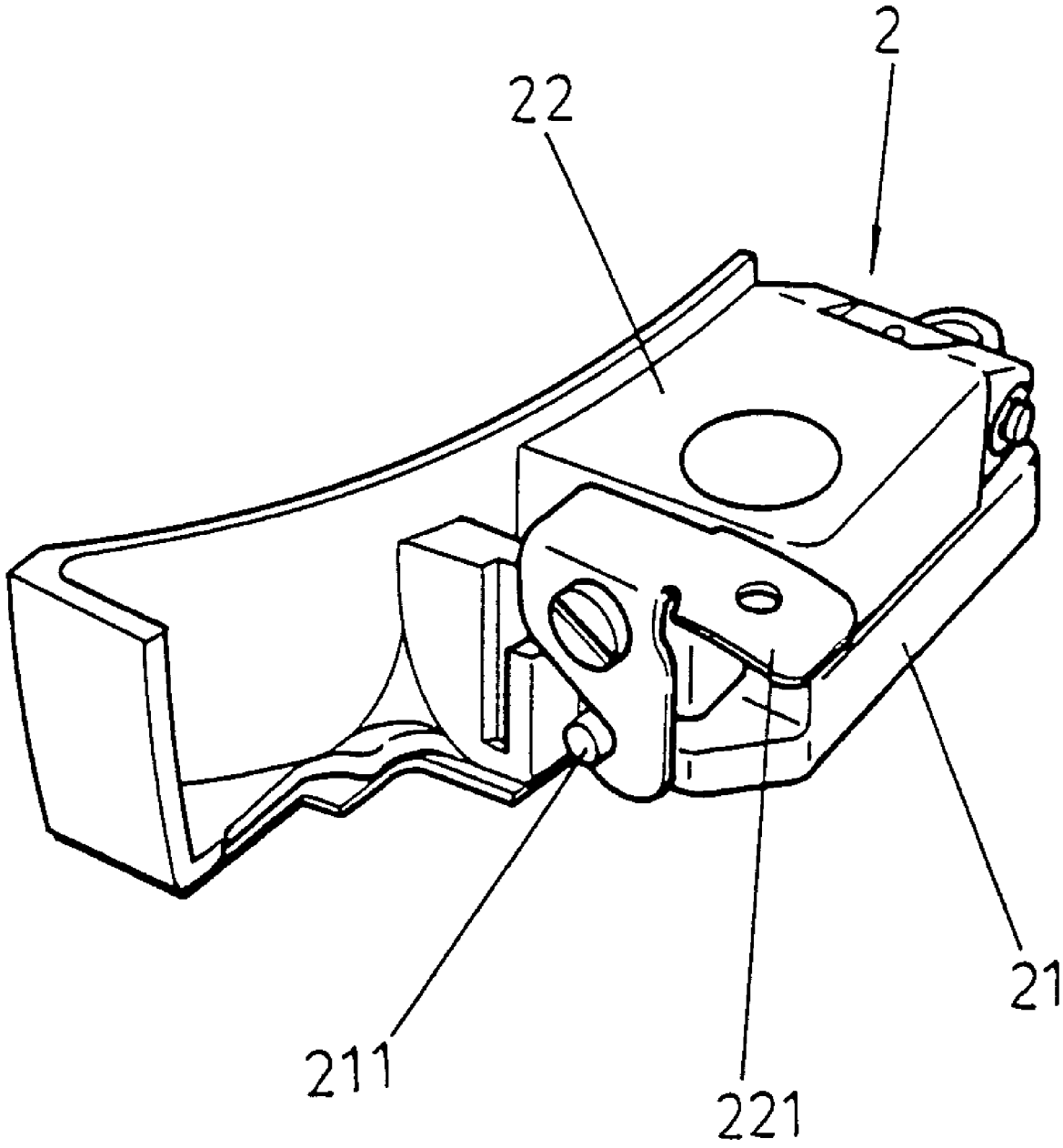
FIG. 3 is a perspective view of a thickness adjusting mechanism of the coin counter in accordance with the present invention.
Figure 4:
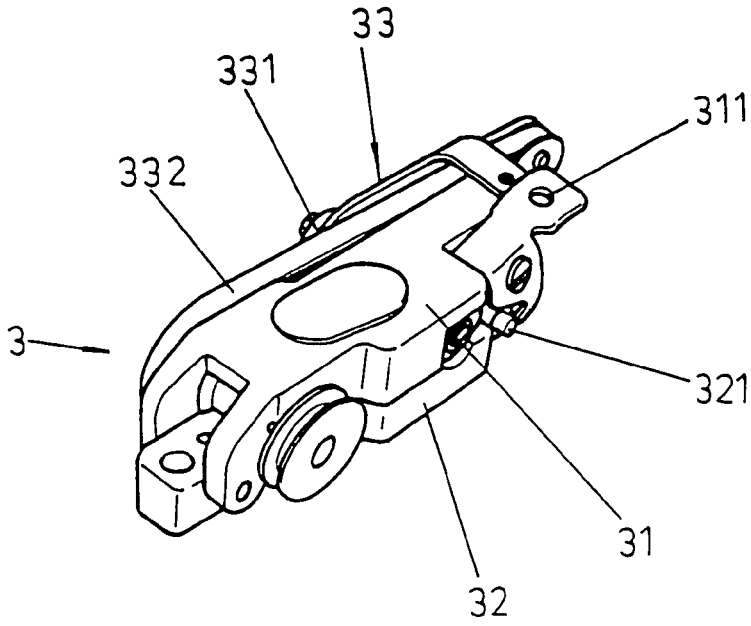
FIG. 4 is a perspective view of a coin forwarding mechanism of the coin counter in accordance with the present invention.
Figure 5:
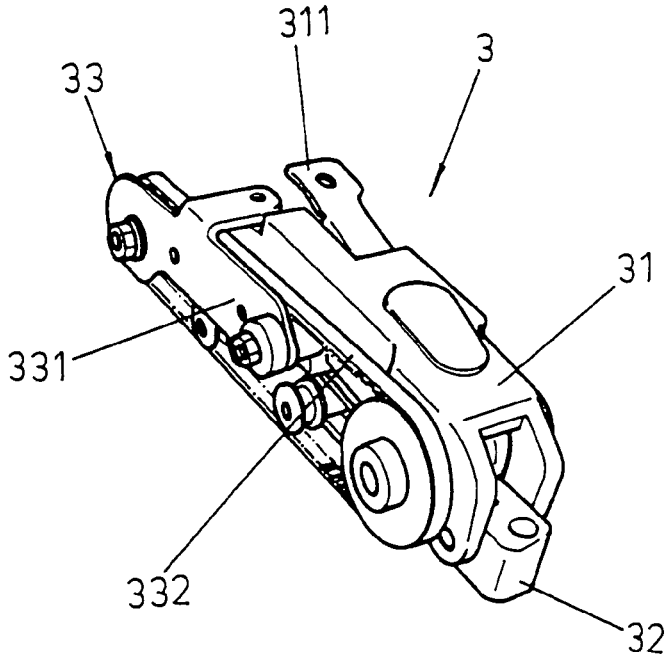
FIG. 5 is another perspective view of the coin forwarding mechanism.
Figure 6:
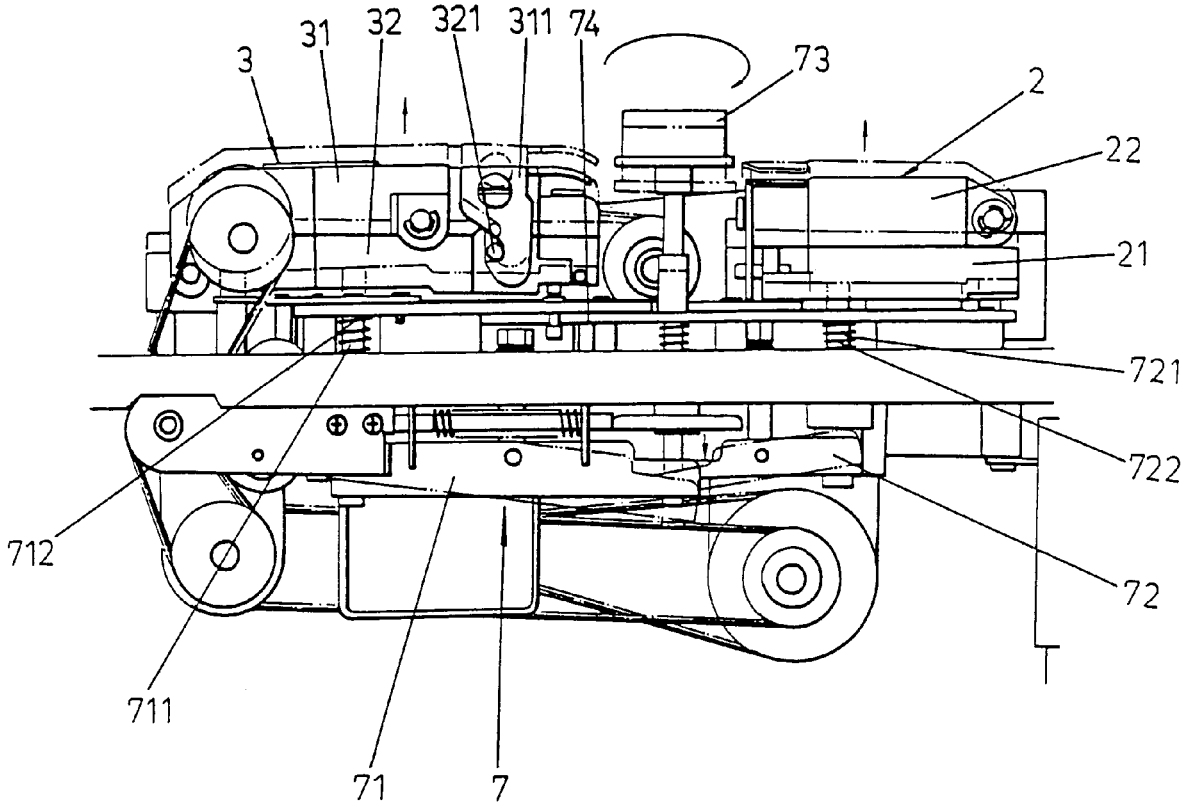
FIG. 6 is a side elevational view of the coin counter of the present invention with the enclosure removed to particularly show the thickness adjusting mechanism.
Figure 7:
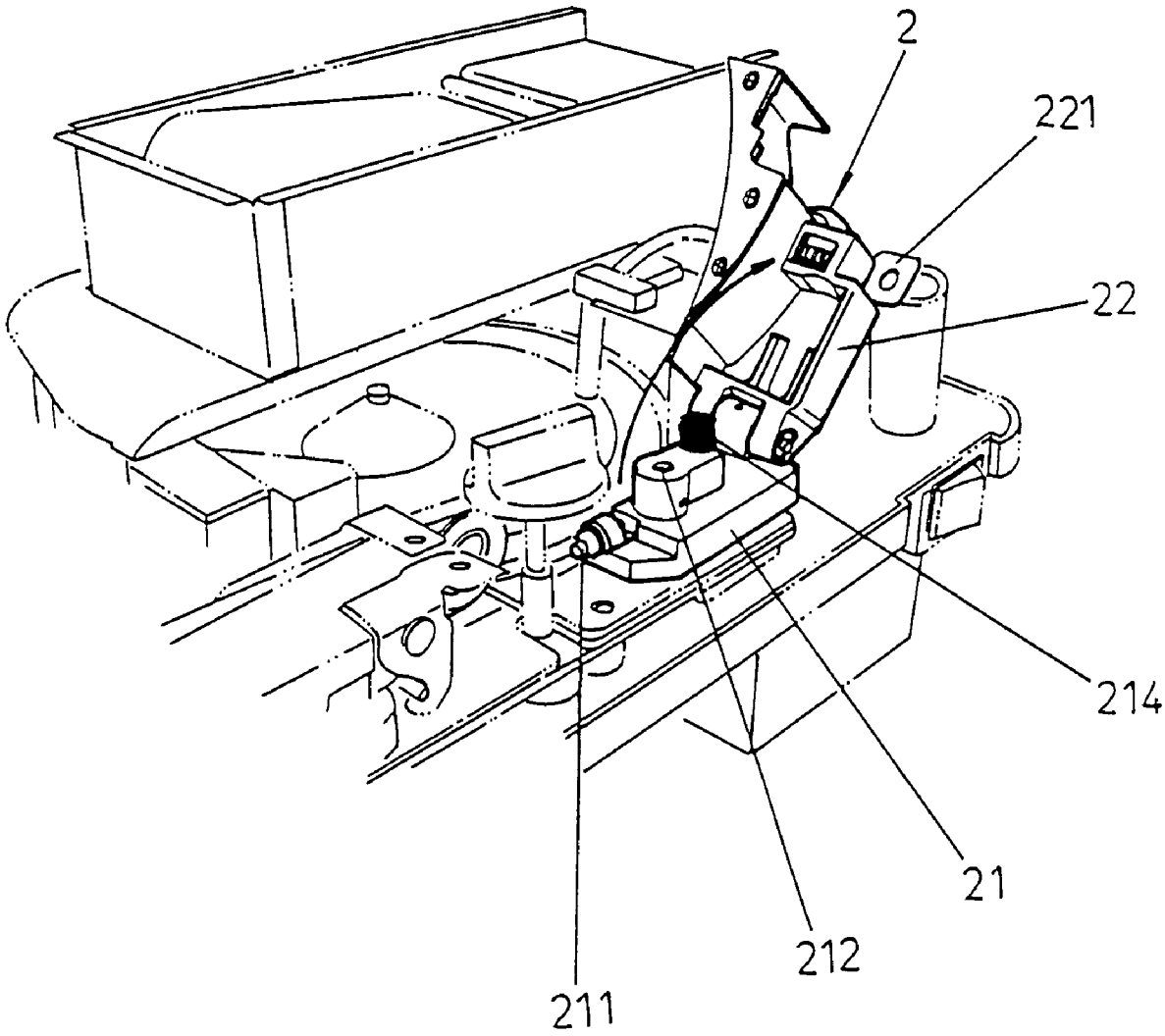
FIG. 7 is a perspective view of a portion of the coin counter of the present invention with the enclosure removed to particularly illustrate the operation of the thickness adjusting mechanism.

An operation device 7 is arranged at one side of the chute 12. The operation device 7 comprises first and second plates 71, 72 (see FIG. 6). The first plate 71 has an end from which a post 711 extends. The second plate 72 is arranged at an opposite end of the first plate 71. A post 721 extends from an end of the second plate 72. Both posts 711, 721 are fixed on the chassis 1 and a baffle plate 74 is arranged between the posts 711, 721. An adjusting valve 73 is arranged on a connection between the first and second plates 71, 72.

The thickness adjusting mechanism 2 is mounted to the post 721 of the second plate 72 and comprises a base 21 and an adjuster 22 pivoted to one side of the base 21. A locking element 211 is provided at the opposite side of the base 21. The adjuster 22 comprises a hook element 221 engageable with the locking element 211. A fixing hole 212 is defined in the base 2 for fitting over and thus fixing the thickness adjusting mechanism 2 to the post 721 of the second plate 72. A fastener 213 secures the thickness adjusting mechanism 2 on the post 721 of the second plate 72. A resilient member 214 is provided on the base 21 of the thickness adjusting mechanism 2 in proximity of the fixing hole 212, serving as buffering between the base 21 and the adjuster 22. Another resilient member 722 is arranged between the thickness adjusting mechanism 2 and the post 721 of the second plate 2.

The coin forwarding mechanism 3 is mounted to the post 711 of the first plate 71. The coin forwarding mechanism 3 comprises a cover 31 and a base 32 pivoted to one side of the cover 31. A coin moving device 33 is pivotally attached to one side of the base 32, comprising a roller set 331 comprised of rollers and a coin driving member 332 surrounding the rollers of the roller set 331. On the opposite side of the base 32, a locking element 321 is provided, which is engageable with a hook element 311 mounted on the cover 31. A fixing hole 322 is defined in the base 32 that is fit over the post 711 of the first plate 71 to attach the base 32 of the coin forwarding mechanism 3 to the post 711. A fastener 323 secures the coin forwarding mechanism 3 to the post 711. A resilient member 712 is arranged between the coin forwarding mechanism 3 and the post 711 of the first plate 71.

With the above-described arrangement, the thickness adjusting mechanism 2 and the coin forwarding mechanism 3 are made independent of each other as individual sub-assemblies, which allows ready mounting/dismounting for easy maintenance and repairing.

Also referring to FIGS. 6-9, to count coins, an operator sets the width adjuster 13 to the desired width that corresponds to the diameter of the kind of coins to be counted and then operates the thickness adjusting mechanism 2 by controlling the adjusting valve 73. The adjusting valve 73 acts upon the first and second plates 71, 72, causing the second plate 72 to move the post 721. The thickness adjusting mechanism 2 can be set to the desired thickness corresponding to the thickness of the kind of coins to be counted by simply moving the post 721 and the second plate 72 upward or downward.

Coins to be counted may then be positioned into the receiving hopper 61. The coins that are received in the hopper 61 are conveyed to the rotary disk 11 by the conveyance mechanism 4. The rotary disk 11 is rotated by the power mechanism 5 under the control of the control circuit 14, which induces a centrifugal force acting upon each coin, which forces the coin to enter the chute 12 where the coin is driven by the coin driving member 332 arranged on the roller set 331 of the coin moving device 33 in the direction toward the coin dispensing structure 62. The coin is then discharged through the coin dispensing structure 62.

Due to the thickness setting obtained by the thickness adjusting mechanism 2, as well as the width setting by the width adjuster 13, only the coins of the desired width (diameter) and the thickness are qualified to pass to the chute 12 and thus only the qualified coins can be discharged through the coin dispensing structure 62. Coins that do not have the desired thickness and diameter fall off the chute 12 and go into the coin return opening 63.

In case that coins jam inside the coin counter during a counting operation, the operator may inspect the thickness adjusting mechanism 2 first by releasing the hook element 221 from the locking element 211, which allows the adjuster 22 of the thickness adjusting mechanism 2 to separate from the base 21 for visual inspection and removal of jamming objects.

To fix coin jamming inside the coin forwarding mechanism 3, the operator may move the coin moving device 33, by rotation with respect to the base 32 of the coin forward mechanism 3, from an operation position to an open, maintenance position, for visual inspection and removing jammed coin, if any. If this cannot fix the problem, the operator may further release the hook element 311 of the cover 31 of the coin forwarding mechanism 3 from the locking element 321 of the base 32 and this exposes inside of the coin forwarding mechanism 3 for carrying out maintenance and jamming removal operation.

Figure 10:
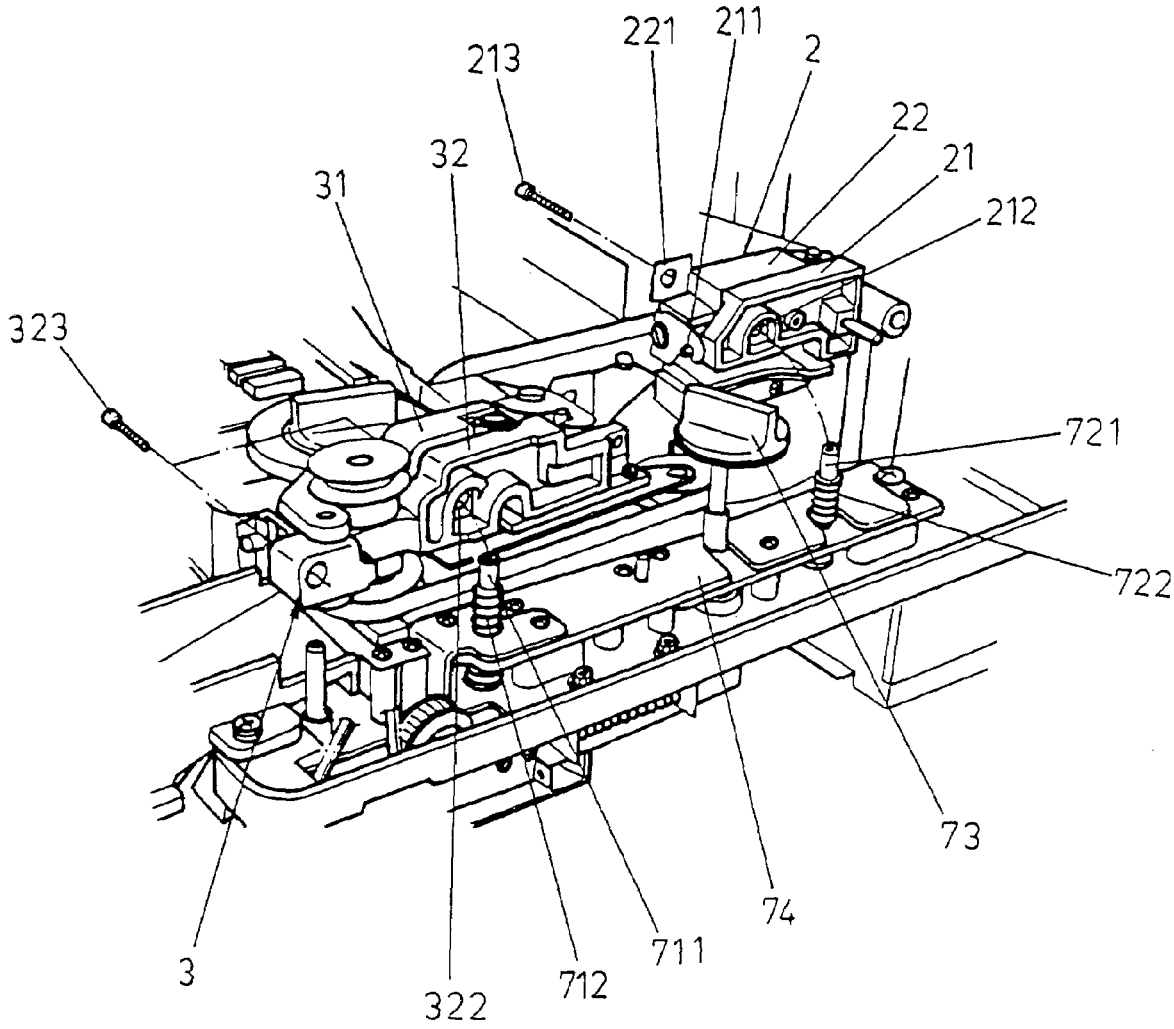
FIG. 10 is a perspective view of the coin counter illustrating separating the thickness adjusting mechanism and the coin forwarding mechanism from a chassis of the coin counter of the present invention.

Also referring to FIG. 10, it can be clearly seen that the thickness adjusting mechanism 2 and the coin forwarding mechanism 3 are separate units respectively mounted to the posts 712, 721 by individual fasteners 213, 323. This allows the thickness adjusting mechanism 2 and the coin forwarding mechanism 3 to be independently dismounted by loosening the associated fastener 213, 323. Thus, maintenance and repairing operation can be individually and separately done for each of the thickness adjusting mechanism 2 and the coin forwarding mechanism 3. Apparently, mounting/dismounting, maintenance, and repairing of the major parts of the coin counter can be readily done, which effectively lowers the costs for manufacturing and maintenance.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A coin counter comprising:

a chassis supporting a rotary disk and a chute extending from the rotary disk, a conveyance mechanism arranged above the rotary disk, a power mechanism positioned below the chassis and a transmission coupled to the power mechanism, a control circuit arranged on the chassis, a width adjuster arranged alone one side of the chute, a thickness adjusting mechanism and a coin forwarding mechanism arranged in the proximity of the chute, and an operation device arranged below one side of the chute and comprising:

a first plate having one end from which a first post extends and an opposite end at which a second plate is arranged, the second plate having an end from which a second post extends, the first and second posts being fixed to the chassis and a baffle plate being arranged between the first and second posts, an adjusting valve being coupled to both the first and second plates;

wherein the thickness adjusting mechanism comprises a base defining a fixing hole fit over the second post and an adjuster pivoted to one side of the base, an opposite side of the base forming a locking element with which a hook element formed on the adjuster is engageable; and wherein the coin forwarding mechanism comprises a cover and a base pivoted to one side of the cover and defining a fixing hole fit over the first post, a coin moving device being pivotally attached to one side of the base, the base also forming a locking element with which a hook element formed in the cover is engageable;

whereby the thickness adjusting mechanism and the coin forwarding mechanism are individual sub-assemblies, which facilitates ready mounting/dismounting for repairing and maintenance.

2. The coin counter as claimed in claim 1 further comprising an enclosure housing the chassis, the enclosure forming a receiving hopper corresponding in position to the conveyance mechanism and a coin dispensing structure corresponding in position to the chute, the enclosure also forming a coin return opening below the chute.

3. The coin counter as claimed in claim 1, wherein the thickness adjusting mechanism comprises a resilient member between the base and the adjuster in proximity of the fixing hole to serve as buffering between the base and the adjuster.

4. The coin counter as claimed in claim 1 further comprising a fastener securing the thickness adjusting mechanism to the second post.

5. The coin counter as claimed in claim 1, wherein the coin forwarding mechanism has a coin moving device having a set of rollers and a coin driving member surrounding the rollers.

6. The coin counter as claimed in claim 1, wherein the coin forwarding mechanism is secured to the first post by a fastener.

7. The coin counter as claimed in claim 1, wherein a resilient member is arranged between the second post and the thickness adjusting mechanism.

8. The coin counter as claimed in claim 1, wherein a resilient member is arranged between the first post and the coin forwarding mechanism.

9. The coin counter as claimed in claim 1, wherein the adjusting valve controlling the first plate and the second plate, the second plate controlling a movement of the second post.

10. The coin counter as claimed in claim 1, wherein the thickness adjusting mechanism is adjustable between a range of predetermined thicknesses by selectively moving the second post and the second plate upwardly and downwardly.

* * * * *